United States Patent [19]

Oehr

[11] 4,130,467

[45] Dec. 19, 1978

[54] PROCESS FOR PLATING LEAD DIOXIDE

[75] Inventor: Klaus H. Oehr, Surrey, Canada

[73] Assignee: British Columbia Research Council, Vancouver, Canada

[21] Appl. No.: 898,826

[22] Filed: Apr. 21, 1978

Related U.S. Application Data

[63] Continuation-in-part of Ser. No. 774,673, Mar. 7, 1977, abandoned.

[51] Int. Cl.[2] ..... C25B 1/30

[52] U.S. Cl. ..... 204/57

[58] Field of Search ..... 204/57

[56] References Cited

U.S. PATENT DOCUMENTS

| | | | |
|---|---|---|---|
| 900,502 | 10/1908 | Ferchland et al. | 204/57 |
| 925,599 | 6/1909 | Russ et al. | 204/213 |
| 1,254,046 | 1/1918 | King | 204/213 |
| 2,133,324 | 10/1935 | Hosdowich | 204/201 |
| 2,606,148 | 8/1952 | Portanova et al. | 204/96 |

FOREIGN PATENT DOCUMENTS

| | | | |
|---|---|---|---|
| 893823 | 4/1962 | United Kingdom | 204/57 |

*Primary Examiner*—R. L. Andrews

*Attorney, Agent, or Firm*—Klarquist, Sparkman, Campbell, Leigh, Hall & Whinston

[57] ABSTRACT

A method of completely coating a plurality of substrates with lead dioxide by electrolysis while the substrates are immersed in an electrolyte containing a lead salt. Each substrate has curved surfaces and is able to roll freely. The method comprises tumbling the substrates in a porous barrel rotating about a central anode feeder at a speed of three to eight revolutions per minute. Substrates contact the anode feeder throughout the electrolysis. The anode feeder is of a material that does not dissolve or passivate in the electrolyte under the reaction conditions during the electrolysis. The temperature during the electrolysis is maintained at less than 70° C. A positive current is applied to the anode feeder to maintain an anode current density in the range 1 to 8 milliamps per square centimeter throughout the electrolysis. A negative current is applied to a cathode spaced from the anode.

10 Claims, 4 Drawing Figures

PROCESS FOR PLATING LEAD DIOXIDE

CROSS REFERENCE TO RELATED APPLICATION

This application is a continuation in part of application Ser. No. 774,673 filed Mar. 7th, 1977, now abandoned.

FIELD OF THE INVENTION

This invention relates to a method of coating a plurality of substrates with lead dioxide by electrolysis.

DESCRIPTION OF THE PRIOR ART

Lead dioxide electrodes are widely used in electrochemistry. Lead dioxide has many favorable properties that make it a good substitute for platinum, dimensionally stable anodes (DSA) and graphite anodes in electrochemistry. For example, in the oxidation of iodic acid to periodic acid with a lead dioxide anode, the current efficiency is about 90% compared to only 1% with a smooth platinum anode under similar operating conditions. Capital equipment and regeneration costs for platinum and DSA are very high. Lead dioxide-coated graphite anodes have been used commercially whereever high current efficiencies can be obtained at high current densities, for example in the production of chlorates, perchlorates, hypochlorite and chlorine.

However, the lead dioxide coating art has not developed a technique for producing lead dioxide electrodes suitable for low current density operation, for example packed bed anodes, that would improve current efficiencies even further in many applications, for example hypochlorite production, chromic acid and periodate production and increase the number of potential applications for the material, for example in organosynthesis. It is an advantage to coat the smallest substrates possible in order to increase the electrolytic cell's surface area to unit volume ratio. Packed bed anodes using lead dioxide-coated substrates require substrates that are completely coated with lead dioxide. The prior art produced only a partially coated substrate, for example up to the electrolyte "waterline", resulting in possible corrosion above the electrolyte level at the electrical bus connection. This problem is eliminated by coating the entire substrate, but the prior art does not reveal how this can be done. In addition, the prior art has not been able to coat a plurality of substrates simultaneously so as to decrease electrode production costs, produce a completely nodule-free electrode or produce adherent, homogeneous electrochemically active and less expensive lead dioxide-coated electrodes having thin coatings below about 800 microns in thickness.

The use of rotating barrels in electroplating is well known. However, in such plating there is a central cathode that contacts the material to be plated, typically a metal to be plated with a metal such as chromium. Furthermore, the coating applied in prior barrel plating apparatus is typically about 20 microns, a thickness far too small for the requirements of lead dioxide-coated electrodes.

SUMMARY OF THE INVENTION

The present invention seeks to provide a method of coating a plurality of substrates with lead dioxide.

In a first aspect the present invention is a method of completely coating a plurality of substrates with lead dioxide by electrolysis while the substrates are immersed in an electrolyte containing a lead salt, each substrate having a curved surface and being able to roll freely, comprising tumbling the substrates in a porous barrel rotating about a central anode feeder at a speed of three to eight revolutions per minute with substrates contacting the anode feeder throughout the electrolysis, the anode feeder being of a material that does not dissolve or passivate in the electrolyte under the reaction conditions during the electrolysis, maintaining the temperature of the electrolyte at less than 70° C. and applying a positive current to the anode feeder to maintain an anode current density in the range 1 to 8 milliamps per square centimeter throughout the electrolysis, and applying a negative current to a cathode spaced from the anode.

The apparatus used in the method of the present invention may be considered a specialized barrel apparatus, ideally suited to producing much thicker coatings than with conventional barrel plating. A straightforward use of the conventional barrel plating apparatus, with simple reversal of the direction of current, does not provide useful results. There are two major problems.

1. The substrates to be coated adhere to each other or to the center shaft anode feeder for too long without shifting position. An electrodeposit forms between the substrate and the anode feeder, joining them together. As more and more substrates behave in this fashion the anode feeder becomes dendritic and traps even more substrates, accelerating the problem. This sticking together can be sufficiently serious to jam the barrel.

2. Current flows from the cathode, through the electrolyte and to the anode feeder, bypassing the substrates inside the barrel. This results in a very high current density at the anode feeder electrode, resulting in a poor, dendritic deposit as in the first problem and with the same results. This problem also causes the major portion of the lead dioxide to be coated on the feeder rather than on the anodic substrates.

The first problem is increased if the substrates don't roll freely, if the barrel is tumbled too quickly, thus not allowing the substrates to drop independently or roll properly or, in certain circumstances, if the anode feeder remains stationary. The first problem is avoided in the present invention generally by the use of curved substrates, in certain aspects by rotating the anode feeder in order to keep the substrates agitated, both at the outside and the inside of the bed, and by tumbling the barrel at low speed. An additional advantage of slow tumbling and curved substrates is that abrasion of the substrate and the feeder, especially in the case of graphite, is kept to a minimum. This is important during the early stages of lead dioxide coating.

The second problem is caused by the electrical resistance of a first circuit path, namely from the cathode to the electrolyte, to the substrates, to the anode feeder being similar to the electrical resistance of a second circuit path from the cathode to the electrolyte to the anode feeder. This problem, which would be drastic if conventional barrel plating designs were used in the process of the present invention, results in very low deposition of lead dioxide on the anode substrates relative to the anode feeder. This problem is solved in the process of the present invention by using curved rather than irregularly shaped articles which give electrical contact along an entire side or end rather than point electrical contact. Cylinders are especially suitable. The use of relatively low temperature for the electrolyte, at least when compared with conventional lead dioxide coating recipes; the use of a low anode current density and, in the apparatus, the provision at both ends of the anode feeder of plastic sleeves to increase the electrical resistance of the second circuit path relative to the first circuit path also alleviate the problem. In addition the end of the barrel should be sealed to prevent current bypassing the multiple anode substrates.

Although a feature of solving both the above problems is a rotating anode feeder, a stationary anode feeder can be used. However, the rotating anode feeder is preferred. The use of a rotating anode feeder coats evenly, thus allowing a higher applied current to be achieved, which accelerates the coating rate without sacrificing the substrate coating quality or causing barrel jamming due to dendritic coating on the feeder. A rotating shaft will ensure better contact with multiple substrates because it has a very even, dense and homogeneous coating. Further, after being used in substrate coating the rotating center shaft can be reused without modification if its coating is not too thick. Alternatively it may be removed from the cell and used as a conventional lead dioxide anode. In the case of a graphite anode feeder, the lead dioxide coating can be easily removed by immersion of the anode feeder in a dilute mixture of nitric acid and hydrogen perioxide. There is no damage to the feeder.

As the central anode feeder graphite or any material that, when made anodic, anodizes on the surface to produce an adherent, electrically-conductive, non-passive metal oxide coating that does not dissolve to contaminate the coating solution may be used. The same also applies to the substrate material. However, in both case, graphite is preferred. Graphite is less expensive and lighter than other possible substrates, which include titanium, nickel, tantalum, ruthenium, silver, platinum and iridium. In addition graphite does not have to be degreased or cathodized as in the case with, for example, titanium. Thus the use of graphite eliminates considerable expense.

Generally speaking conventional plating cathode materials used in barrel plating apparatus, for example cooper and aluminum, are not acceptable in the method of the present invention. For example, copper will quickly corrode as an anode in the present invention since the electrolyte frequently contains nitric acid. Virtually no lead dioxide deposit would be obtained on the parts. Aluminum, if used as the anode, would produce a non-electrically conductive, but adherent metal oxide film. Thus, there is no barrel plating cell in the prior art having a cathode center shaft made of the materials used as the anode feeder in the present invention. This is due to higher costs or to lower electrical conductivities than conventional copper cathodes. Of course, it must be remembered that the function of barrel plating in the prior art is to coat metals, not metal oxides.

The cathode current density used in the method of the present invention is typically approximately fifteen milliamps per square centimeter at three amps current, giving a cathode to anode current density ratio in the range of about 15 to about 2, based on the above anode current density.

BRIEF DESCRIPTION OF THE DRAWINGS

The invention will be further illustrated by reference to the drawings, which illustrate apparatus for carrying out the method of the present invention, and by the examples that follow. In the accompanying drawings.

DESCRIPTION OF THE PREFERRED EMBODIMENTS

Figure 1:
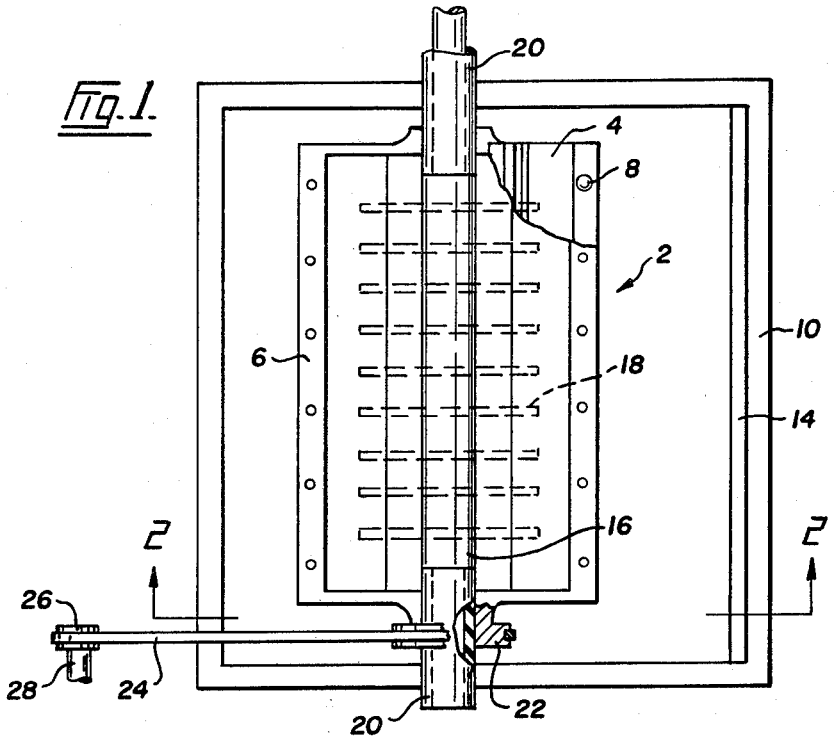
FIG. 1 is a plan view of one embodiment of an apparatus useful in the method of the present invention.
Figure 2:
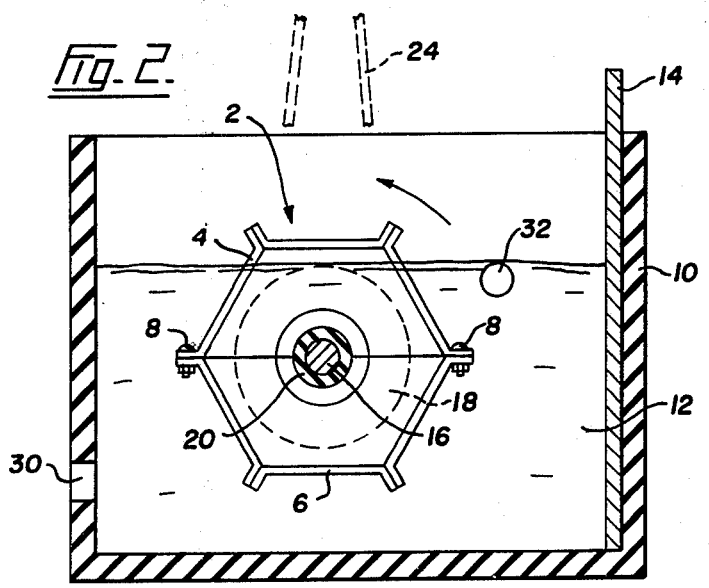
FIG. 2 is a view on the line 2—2 on FIG. 1.

FIGS. 1 and 2 of the drawings illustrate a lead dioxide electroplating cell that may be called a barrel cell because of the analogy to barrel plating. The drawings illustrate a hexagonal barrel 2 formed of an upper section 4 and a lower section 6. Although not shown in the drawings the barrel is perforated, for example with $\frac{1}{8}$ inch holes to provide a percentage perforation of approximately 35%. The two parts 4 and 6 of the barrel 2 are held together by bolts 8 of a non-conducting material, for example of a plastic.

The barrel 2 is positioned in a tank 10 of a non-conducting material, for example, of plastic and is immersed in an electrolyte 12. The electrolyte will contain amongst other things, a lead salt, for example lead nitrate. There is a cathode 14, for example of copper, at one side of the tank 10. At the centre of the tank and of the barrel 2 there is an anode feeder 16. The anode feeder 16 is of graphite or any conducting material that will, when made anodic, produce an adherent electrically conductive, nonpassive metal oxide coating that does not dissolve to contaminate the electrolyte. The anode feeder 16 may be fitted with discs 18 as shown in dotted outline in the drawings. The discs 18 may be of any of the conducting materials described above. The anode feeder 16 may be in the form of a tube. There are means (not shown in FIGS. 1 and 2) for attaching the anode feeder 16 to a positive DC power supply and for attaching the cathode 14 to a negative DC power supply.

At each end of the anode feeder 16 there are insulator sleeves 20. These insulator sleeves 20 are desirably of a plastic material having a low coefficient of friction, for example of polytetrafluorethylene (PTFE). The barrel 2 has an integral pulley 22 driven by an electric motor (not shown) through belt 24 and drive pulley 26, mounted on the drive shaft 28 of the electric motor. Thus, by the drive from the electric motor, the barrel 2 can be rotated upon the anode 16, which does not rotate.

There is an electrolyte input 30 and an outlet 32- see FIG. 2. The system can thus operate with continuous circulation of the electrolyte. The electrolyte is circulated to a storage container, which is not shown.

To carry out the process of the present invention in the illustrated apparatus the following steps are carried out. First, it is desirable to immerse the substrate in distilled water for, for example, 24 hours in order to remove air bubbles. It is clear that it is undesirable to have air coming from a porous substrate, for example a graphite substrate, during electrolysis.

The substrate is next placed in the bottom half 6 of the barrel 2. The upper section 4 is then attached to the lower section 6 by bolts 8. The barrel centre shaft or anode 16 is connected to graphite bus bars (which are not shown but which are conventional) and the barrel 2 with its substrate content is immersed in an electrolyte in the tank 10.

The substrate is tumbled in the barrel 2 at a desired, relatively slow number of revolutions per minute, for example 5 to 8 r.p.m. The barrel 2 rotates upon the centre shaft anode 16, which remains stationary.

In an embodiment of the invention that has provided excellent results the substrate comprised 100 graphite rods which are immersed for 24 hours in distilled water to remove entrained air bubbles. The electrolysis referred to above was carried out at 65° to 69° C. in an electrolyte consisting of:

$Pb(NO_3)_2$ — 200 g/l
$Cu(NO_3)_2 . 3H_3O$ — 10 g/l
$Ni(NO_3)_2 . 6H_2O$ — 10 g/l
Igepal (trademark for a surfactant) — 0.75 g/l
NaF — 0.5 g/l
$HNO_3$ — 4 g/l The rods were tumbled in the barrel 2 shown in FIGS. 1 and 2 at 8 r.p.m. using a direct current of 3 amps. The current was applied to the stationary anode feeder 16 for 29 hours. Lead monoxide was added to the electrolyte periodically (e.g. 24g every 2 hours) to maintain the pH and lead concentration relatively constant. Some of the rods contacted the anode feeder 16 throughout the electrolysis, thereby carrying current through the entire substrate bed. In the drawings the substrate has not been shown in order to retain clarity.

The graphite rods were of 6 inches length and 3/16 inches diameter. They were coated simultaneously with an approximately 140 micron thick lead dioxide coating. The laboratory scale apparatus used had an anode of 5½ inches exposed length and ⅝ inches diameter. The anode feeder 16 was of graphite.

Using three amps for about 30 hours in the above embodiment can lead to lead dioxide build-up on the anode feeder 16, particularly at the ends of the feeder 16. This results in poor contact with the rods or other substrates. To solve this problem it was found desirable to stop plating after about 8 hours. The partially coated substrates were removed from the barrel and the anode feeder soaked in a mixture of dilute nitric acid with hydrogen peroxide to dissolve the lead dioxide coating. After removal of the lead dioxide coating from the anode in this way the anode was thoroughly washed with water then reused for, typically, another 8 hours.

Upon conclusion of the electrolysis after 29 hours one lead dioxide coated rod was selected at random and used to produce sodium hypochlorite from a sodium chloride solution at 50 mamp/cm$^2$ current density and 94% current efficiency. In contrast an uncoated graphite rod having the same dimensions gave only 55% current efficiency under identical use.

Figure 3:
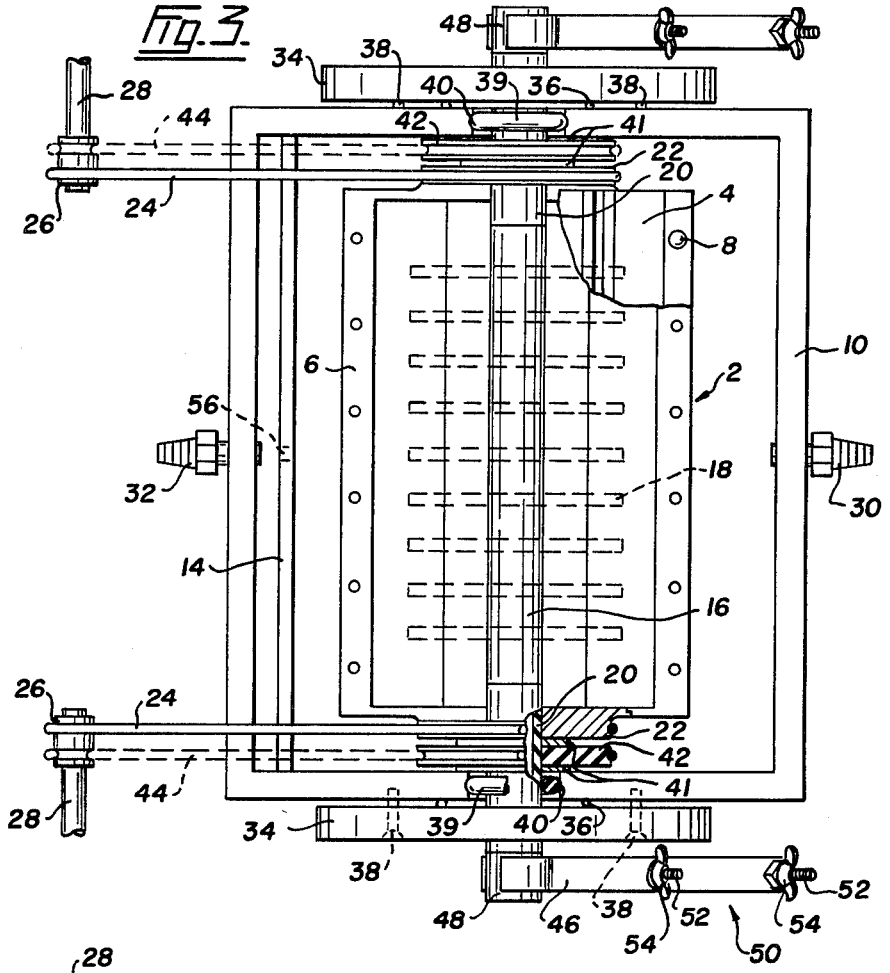
FIG. 3 is a plan view of a further apparatus useful in the method of the present invention.
Figure 4:
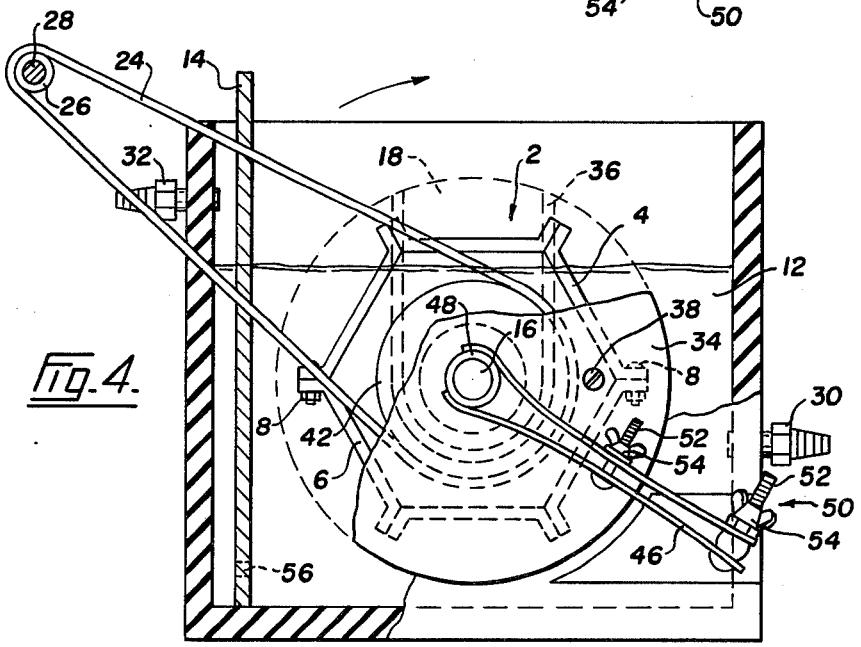
FIG. 4 is an end view of the apparatus of FIG. 3.

In the apparatus illustrated in FIGS. 3 and 4 certain variations in the apparatus illustrated in FIGS. 1 and 2 are shown. Where common items are illustrated the same reference numerals have been used in FIGS. 3 and 4 as in FIGS. 1 and 2.

A principal difference between the apparatus of FIGS. 1 and 2 and that illustrated in FIGS. 3 and 4 is that in the apparatus of FIGS. 3 and 4 the central anode feeder 16 may be rotated.

In the apparatus of FIGS. 3 and 4 there is a non-conducting tank sealer wall 34 separated from the each end tank wall by a sealer ring 36 as shown in FIG. 3. The end of sealer walls are located by machine screws 38. There is a sealing O-ring 39 located in a channel 40 in each end wall of the tank, contacting the sleeves 20.

As a particular means of avoiding the current bypassing the multiple anodes in the barrel 2 the apparatus illustrated in FIGS. 3 and 4 is provided with non-conducting antifriction sleeves 41 made of, for example, PTFE.

Provision for rotating the central anode feeder 16 is by a belt wheel 42 attached to the anode feeder 16 outside the barrel 2. A non-conducting belt 44 (shown in broken lines) connects with the drive shaft 28. The anode feeder 16 can be rotated in the same direction as the barrel 2 or, by crossing the belt 44 can be made to rotate in a direction counter to the rotation of the barrel 2.

It should be noted that duplicates of drive shaft 28, belts 24 and 44 and belt wheels 22 and 42 are provided at both ends of the tank 10 shown in FIGS. 3 and 4, which offers another means of rotating the barrel 2 and the anode feeder 16 contrary to each other.

In FIGS. 3 and 4 there is also illustrated a current supply means to the apparatus comprising an electrical bus connector 46 contacting a conducting sleeve 48 attached on the end of the centre anode feeder 16. There are positive DC terminals 50 in the form of bolts 52 having wing nuts 54 to contact a supply of positive electric current.

In the apparatus of FIGS. 3 and 4 there is an opening 56 through the cathode 14 to permit proper flow of the electrolyte 12.

Using the apparatus illustrated in FIGS. 3 and 4 graphite cylinders or pellets approximately 4900 microns long and approximately 4900 microns in diameter were coated.

In this experiment the electrolyte was 6 litres of deionized water containing the following substrates:

1200 g — $Pb(NO_3)$
60 g — $Cu(NO_3)_2 . 3H_2O$
60 g — $Ni(NO_3)_2 . 6H_2O$
36 ml — concentrated $HNO_3$
4.5 g — Igepal CO-710 (trademark)
3 g — NaF 2335 Graphite cylinders were placed in the barrel 2. The barrel 2 and anode feeder 16 were simultaneously rotated at 3.5 rpm in a clockwise direction with a vertical cathode sheet to the left of, but not touching, the barrel. The barrel contained a ⅝ inch diameter center shaft 16 with PTFE sleeves 20 at either end of a 5½ inches exposed graphite anode centre shaft. Plating was carried out for 17.5 hours at 10 amps using a constant current power supply. The electrolyte temperature ranged from 25°-65° C. during electrolysis which was carried out in three stages of six hours, 6.75 hours and 4.8 hours. The cell was drained of electrolyte between stages and electrolyte was changed entirely every eight hours. Lead monoxide (35 grams) was added every hour to the electrolyte to neutralize acid formed by the reaction:

$$Pb^{++} + 2H_2O \rightarrow PbO_2 + 4H^+ + 2e -$$

and to replace lead ions removed by electrodeposition. The anode current density decreased during electrolysis from a starting Figure of 3.7 mamp/cm$^2$ to 3.0 mamp/cm$^2$ due to an increase in substrate surface area with increasing coating thickness. 93.2% of the lead dioxide was coated on the cylinder bed. Only 6.8% of the lead dioxide coating was obtained on the anode feeder shaft. Final coating thickness of the graphite cylinders was 320 microns.

The current efficiency for electrodeposition was 97.3%.

It has been observed that lower tumbling speeds, anode feeder rotation speeds and electrolysis temperature improve coating efficiency, presumably due to improved electrical contact to the anode substrates and poorer electrolyte conductivity — see the second problem described above. For example, when using an electrolyte containing the surfactant available under the trade mark Igepal CO-710 at an anode current density of 3.7 mamp/cm$^2$ (3.4 amps/ft$^2$), 92% percent of the lead dioxide is electrodeposited onto 2335 graphite pellets and 8% of the lead dioxide was coated on the feeder at a barrel rotational speed of 6.5 rpm. The total plating current efficiency was 85% . The electrolysis temperature was 45° to 65° C. By dropping the barrel and feeder speeds to 3.5 rpm and the electrolysis temperature to 25° to 65° C., 93% of the lead dioxide was deposited on the bed and plating efficiency increased dramatically to 97.3%. A rotation speed of 3 rpm is close to optimum.

It is, as described above, possible to rotate the anode feeder in the apparatus of FIGS. 3 and 4 in a direction different from the rotational direction of the barrel, either by crossing over the belt 44 or by providing a drive from the optional drive member to the anode feeder 16 at the opposite end of the apparatus from the drive from which the barrel drive is taken. This is considered to be desirable in coating very small substrates by reducing even further their tendency to stick to the shaft 16 due to the shear force created.

The current densities used in the process of the present invention are substantially lower than has previously been used before either in lead dioxide coating or in the barrel electroplating art. The barrel electroplating art typically uses current densities of 10 to 15 amps per square foot. The lead dioxide plating art typically uses current densities greater than 25 amps per square foot.

Attempts to coat 4900 microns pellets at 11.3 mamp/cm$^2$ (i.e. 10.5 amps/ft$^2$) caused the barrel to jam permanently due to a completely uneven and excessive buildup of lead dioxide on the anode feeder rather than on the pellets. This uneven buildup on the feeder due to a high anode current density causes the rods to roll improperly, causing breakage in the case of graphite and poor electrical contact between rods and the feeder and from rod to rod. The problem is not quite as bad in the case of pellets. However, it should be noted that, generally speaking, lower current densities are used for rods (about 1.25 mamp/cm$^2$) compared with the current density for cylinders (3.0 mamp/cm$^2$).

Concerning the surface active agent used in the electrolyte in the process of the present invention, the compounds available under the trade mark Igepal are polyoxyethylene derivatives of hydroxy compounds, usually akyl phenols.

In the above rod coating experiments, Igepal CO-530 gave adequate results but Igepal CO-710 and Igepal CO-880 give good results. Igepal CO-710 is more soluble, especially at lower temperatures, making it preferable to Igepal CO-880. Igepal CO-710 is a liquid at room temperature but Igepal CO-880 is a solid. It is clearly easier to add a liquid to the electrolyte than a solid.

I claim:

1. A method of completely coating a plurality of substrates with lead dioxide by electrolysis while the substrates are immersed in an electrolyte containing a lead salt, each substrate having curved surfaces and being able to roll freely, comprising tumbling the substrates in a porous barrel rotating about a central anode feeder at a speed of three to eight revolutions per minute with substrates contacting the anode feeder throughout the electrolysis, the anode feeder being of a material that does not dissolve or passivate in the electrolyte under the reaction conditions during the elecrolysis, maintaining the temperature during the electrolsis at less than 70° C., applying a positive current to the anode feeder to maintain an anode current density in the range 1 to 8 milliamps per square centimeter throughout the electrolysis and applying a negative current to a cathode spaced from the anode.

2. A method as claimed in claim 1 in which the substrates are rods and in which the starting current density is about 1.2 milliamps per square centimeter.

3. A method as claimed in claim 1 in which the substrates are cylinders and in which the starting current density is about three milliamps per square centimeter.

4. A method as claimed in claim 1 in which the temperature is maintained in the range 65° to 69° C.

5. A method as claimed in claim 1 in which the lead salt is lead nitrate.

6. A method as claimed in claim 1 in which the barrel is rotated 3.5 revolutions per minute.

7. A method as claimed in claim 1 in which the central anode feeder is also rotated.

8. A method as claimed in claim 1 in which the central anode feeder is of graphite.

9. A method of coating a plurality of rods with lead dioxide by electrolysis while the rods are immersed in an electrolyte at a temperature less than 70° C. and containing a lead salt, comprising tumbling the rods in a porous barrel rotating about a fixed central anode feeder at a speed of 3.6 revolutions per minute with rods contacting the anode feeder throughout the electrolysis, the anode being of a material that does not dissolve or passivate in the electrolyte under the reaction conditions during the electrolysis, applying a positive current to the anode to produce a starting anode current density of about 1.25 milliamps per square centimeter and applying a negative current to a cathode spaced from the anode.

10. A method of coating a plurality of cylinders with lead dioxide by electrolysis while the cylinders are immersed in an electrolyte at a temperature in the range 65° to 69° C. and containing a lead salt, comprising tumbling the cylinders in a porous barrel rotating about a rotating central anode feeder, both the barrel and the feeder rotating at a speed of about 3.5 revolutions per minute with cylinders contacting the anode feeder throughout the electrolysis, the anode being of a material that does not dissolve or passivate in the electrolyte under the reaction conditions during the electrolysis, applying a positive current to the anode to produce a starting anode current density of about 3 milliamps per square centimeter and applying a negative current to a cathode spaced from the anode.

* * * * *